US010352155B2

(12) United States Patent
Wilson et al.

(10) Patent No.: US 10,352,155 B2
(45) Date of Patent: Jul. 16, 2019

(54) TELLURIC REFERENCING FOR IMPROVED ELECTROMAGNETIC TELEMETRY

(71) Applicant: Halliburton Energy Services, Inc., Houston, TX (US)

(72) Inventors: Glenn Andrew Wilson, Singapore (SG); Paul Andrew Cooper, Humble, TX (US)

(73) Assignee: Halliburton Energy Services, Inc., Houston, TN (US)

( * ) Notice: Subject to any disclaimer, the term of this patent is extended or adjusted under 35 U.S.C. 154(b) by 0 days.

(21) Appl. No.: 15/526,664

(22) PCT Filed: Aug. 3, 2016

(86) PCT No.: PCT/US2016/045437
§ 371 (c)(1),
(2) Date: May 12, 2017

(87) PCT Pub. No.: WO2017/024082
PCT Pub. Date: Feb. 9, 2017

(65) Prior Publication Data

US 2018/0291729 A1 Oct. 11, 2018

Related U.S. Application Data

(60) Provisional application No. 62/200,425, filed on Aug. 3, 2015.

(51) Int. Cl.
*E21B 47/12* (2012.01)
*E21B 47/06* (2012.01)
(Continued)

(52) U.S. Cl.
CPC ..... *E21B 47/122* (2013.01); *E21B 47/121* (2013.01); *E21B 47/06* (2013.01);
(Continued)

(58) Field of Classification Search
CPC ..... E21B 47/122
See application file for complete search history.

(56) References Cited

U.S. PATENT DOCUMENTS 4,339,720 A 7/1982 Halverson
4,812,766 A 3/1989 Klein
(Continued)

FOREIGN PATENT DOCUMENTS

WO WO 2015/094318 A1 6/2015

OTHER PUBLICATIONS

Macnae, et al., "Noise Processing Techniques for Time-Domain Em Systems," Geophysics, vol. 49, No. 7, Jul. 1984, pp. 934-994.
(Continued)

*Primary Examiner* — Amine Benlagsir
(74) *Attorney, Agent, or Firm* — Haynes and Boone, LLP

(57) ABSTRACT

An electromagnetic (EM) telemetry system with telluric referencing for use with downhole equipment is described. Embodiments of an EM telemetry system with telluric referencing include a downhole transceiver comprising an encoded signal transmitter, a downhole sensor disposed to monitor the downhole equipment, the downhole sensor coupled to the transceiver, an encoded signal receiver, a reference receiver spaced apart from the encoded signal receiver and communicatively coupled to the encoded signal receiver, and a telluric voltage module coupled to one of the encoded signal receiver and the reference receiver. The telluric voltage module is communicatively coupled to the encoded signal receiver and the reference receiver to receive an encoded signal and a reference signal, respectively, which may include telluric noise. The telluric voltage module synchronizes the encoded signal and the reference signal, subtracts the reference signal from the encoded signal, and outputs a signal free from telluric noise.

17 Claims, 6 Drawing Sheets

(51) Int. Cl.
*E21B 49/00* (2006.01)
*E21B 49/08* (2006.01)

(52) U.S. Cl.
CPC ..... *E21B 47/065* (2013.01); *E21B 49/00* (2013.01); *E21B 49/08* (2013.01)

(56) References Cited

U.S. PATENT DOCUMENTS 4,980,682 A * 12/1990 Klein ..... E21B 47/122 166/66
7,353,132 B2 * 4/2008 Sheard ..... G01V 3/06 702/127
2003/0040882 A1 * 2/2003 Sheard ..... G01V 3/06 702/127
2004/0069514 A1 * 4/2004 Rodney ..... G01V 11/002 174/350
2005/0212520 A1 * 9/2005 Homan ..... G01V 3/30 324/338
2006/0227005 A1 * 10/2006 Fincher ..... E21B 47/12 340/855.4
2008/0265896 A1 * 10/2008 Strack ..... G01V 3/083 324/350
2009/0160445 A1 * 6/2009 Hall ..... G01V 3/28 324/339
2009/0265111 A1 * 10/2009 Helwig ..... G01V 3/083 702/7
2011/0001482 A1 * 1/2011 Alumbaugh ..... G01V 3/088 324/344
2012/0293179 A1 * 11/2012 Colombo ..... G01V 3/26 324/339
2014/0240140 A1 * 8/2014 Switzer ..... E21B 47/122 340/854.6
2015/0061683 A1 * 3/2015 Marsala ..... E21B 47/00 324/355

OTHER PUBLICATIONS

Marsala, et al. "Six-Component Tensor of the Surface Electromagnetic Field Produced by a Borehole Source Recorded by Innovative Capacitive Sensors," SEG Technical Program Expanded Abstracts, 2013, pp. 825-829.
Nichols, et al., "Signals and Noise in Measurements of Low-Frequency Geomagnetic Fields," Journal of Geophysical Research, vol. 93, No. B11, Nov. 10, 1988, pp. 13743-13754.
Rowston, et al., "Cole-Cole Inversion of Telluric Cancelled IP Data," ASEG Extended Abstracts, 2003, vol. 2, pp. 1-4.
Vozoff, et al., "The Magnetotelluric Method in the Exploration of Sedimentary Basins," Geophysics, vol. 37, No. 1, Feb. 1972, pp. 98-141.
International Search Report and the Written Opinion of the International Search Authority, or the Declaration, dated Aug. 3, 2016, PCT/US2016/045437, 15 pages, ISA/KR.

* cited by examiner

TELLURIC REFERENCING FOR IMPROVED ELECTROMAGNETIC TELEMETRY

RELATED APPLICATION

The present application is a U.S. National Stage patent application of International Application No. PCT/US2016/045437, filed on Aug. 3, 2016, which claims priority to U.S. Provisional Application No. 62/200,425, filed on Aug. 3, 2015, the disclosures of which are hereby incorporated by reference in their entirety.

BACKGROUND OF THE DISCLOSURE

Field of the Disclosure

The disclosure generally relates to systems and methods for electromagnetic (EM) telemetry. The disclosure specifically relates to telluric referencing for EM telemetry during drilling, measurement-while-drilling (MWD), and/or logging-while-drilling (LWD) operations.

Background

Electromagnetic (EM) telemetry is a method of communicating from a bottom-hole assembly (BHA) to the surface of a wellbore in drilling applications. For example, the ability to transmit and receive drilling dynamics data may allow for faster drilling, while the ability to transmit and receive formation evaluation data, such as measurement-while-drilling (MWD) and/or logging-while-drilling (LWD) data, may allow for accurate well placement to maximize reservoir value. EM telemetry systems typically operate at frequencies between 1 and 50 Hz, with data rates nominally between 3 and 12 bps from a limited number of communication channels.

Like many communication techniques, one goal of EM telemetry is to provide robust encoded communication signals and high data rates in the presence of noise. The communications signals used in EM telemetry systems may be characterized by a signal-to-noise ratio (SNR) given by the ratio between the strength of the communication signal and the strength of the noise signal. In general, improving the SNR corresponds to improved accuracy of a communication technique, which may be utilized to design communication systems with higher effective data rates, more channels, lower bit error rates, and/or the like.

One source of noise in EM telemetry systems is telluric noise. It is known that geomagnetic pulsations induce telluric currents within the earth from the mHz to Hz frequency bands, and that atmospheric sources (e.g., lightning and/or sferics) induce telluric currents above the Hz band. Indeed, the amplitude of the telluric currents is known to increase inversely with frequency. Telluric currents induce electromagnetic fields that are measured as a noise by the receiver of EM telemetry systems. The telluric noise signal thus degrades the SNR of conventional EM telemetry systems. Accordingly, there is a need for a system and method for improving the SNR of EM telemetry systems. More specifically, there is a need for a system and method for improving the SNR of EM telemetry systems in the presence of telluric noise.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements. Embodiments are described in detail hereinafter with reference to the accompanying figures, in which.

DETAILED DESCRIPTION OF THE DISCLOSURE

Figure 1:
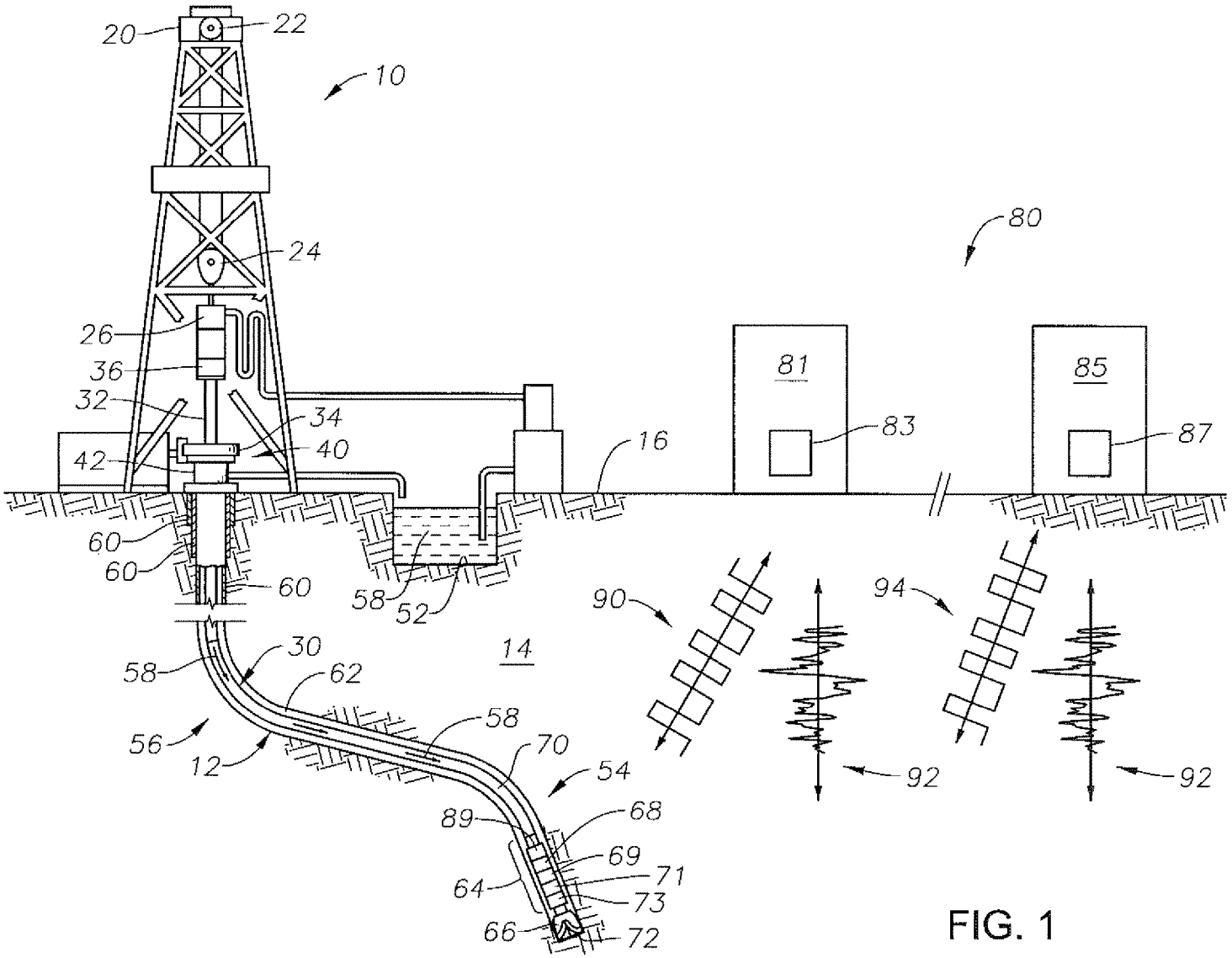
FIG. 1 is a plan view of a land based drilling system incorporating an EM telemetry system of the disclosure.

The disclosure may repeat reference numerals and/or letters in the various examples or figures. This repetition is for the purpose of simplicity and clarity and does not in itself dictate a relationship between the various embodiments and/or configurations discussed. Further, spatially relative terms, such as beneath, below, lower, above, upper, uphole, downhole, upstream, downstream, and the like, may be used herein for ease of description to describe one element or feature's relationship to another element(s) or feature(s) as illustrated, the upward direction being toward the top of the corresponding figure and the downward direction being toward the bottom of the corresponding figure, the uphole direction being toward the surface of the wellbore, the downhole direction being toward the toe of the wellbore. Unless otherwise stated, the spatially relative terms are intended to encompass different orientations of the apparatus in use or operation in addition to the orientation depicted in the figures. For example, if an apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Moreover, even though a figure may depict a horizontal wellbore or a vertical wellbore, unless indicated otherwise, it should be understood by those skilled in the art that the apparatus according to the present disclosure is equally well suited for use in wellbores having other orientations including vertical wellbores, slanted wellbores, multilateral wellbores or the like. Likewise, unless otherwise noted, even though a figure may depict an onshore operation, it should be understood by those skilled in the art that the apparatus according to the present disclosure is equally well suited for use in offshore operations and vice-versa. Further, unless otherwise noted, even though a figure may depict a cased hole, it should be understood by those skilled in the art that the apparatus according to the present disclosure is equally well suited for use in open hole operations.

Generally, in one or more embodiments, an EM telemetry system is provided wherein telluric referencing is used to improve the signal-to-noise ratio (SNR) of encoded signals transmitted and received using EM telemetry during drilling, logging-while-drilling (LWD), measurement-while-drilling (MWD), production or other downhole operations. A reference signal is measured using a reference assembly located a considerable distance (e.g., 10 km) from the transmitter and receiver of the EM telemetry system. A telluric noise voltage signal is determined based on the reference signal and is subtracted from the received encoded signal, thereby cancelling at least a portion of the telluric noise in the received encoded signal. This improves the SNR of the received encoded signal, which in turn facilitates accurate and rapid demodulation and decoding of the received encoded signal and may contribute to higher reliability and faster overall data rates of the improved EM telemetry system relative to conventional EM telemetry systems.

Figure 2:
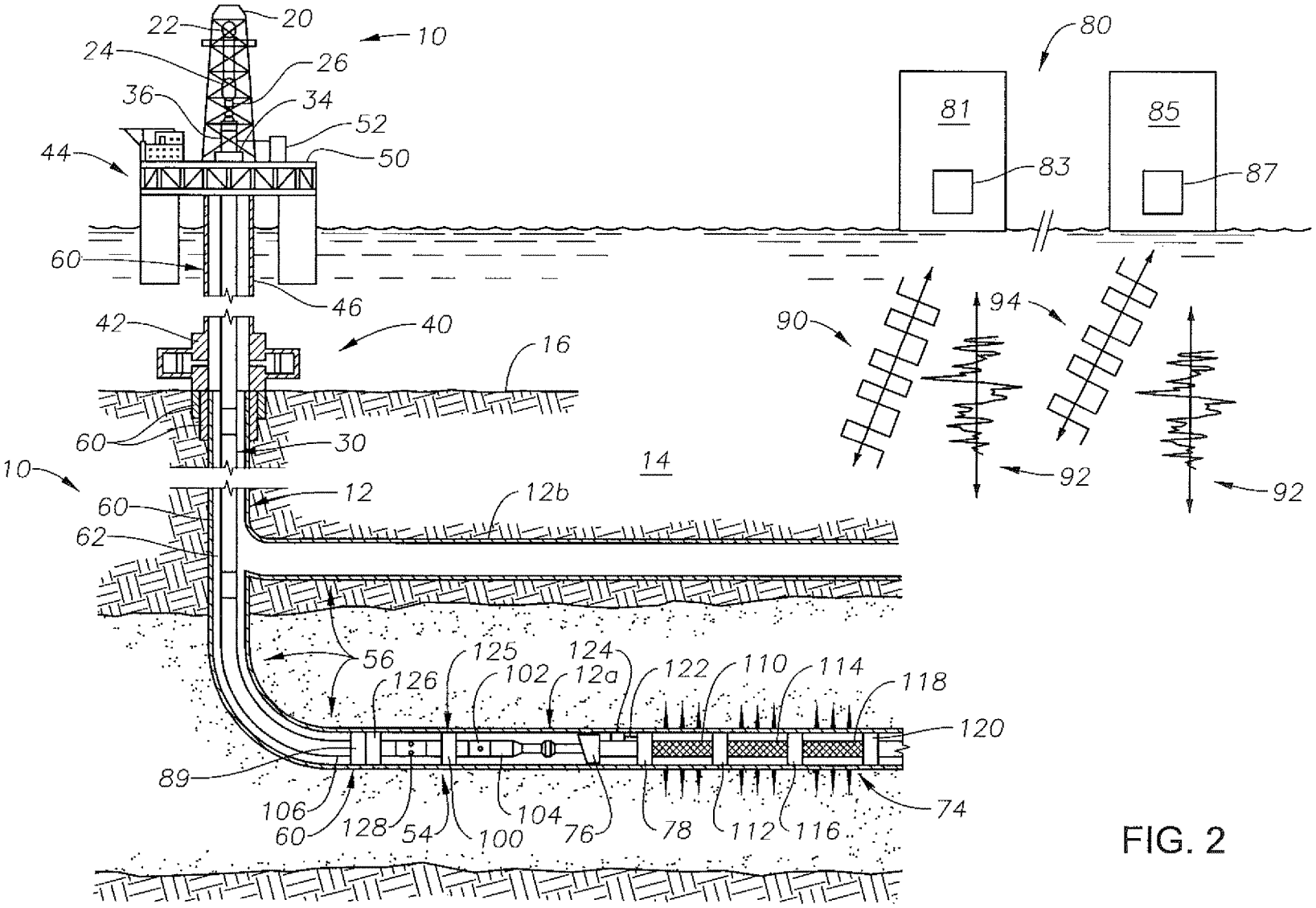
FIG. 2 is a plan view of a marine based production system having an EM telemetry system of the disclosure.

Turning to FIGS. 1 and 2, shown is an elevation view in partial cross-section of a wellbore drilling and production system 10 utilized to produce hydrocarbons from wellbore 12 extending through various earth strata in an oil and gas formation 14 located below the earth's surface 16. Wellbore 12 may be formed of a single or multiple bores 12*a*, 12*b* . . . 12*n* (illustrated in FIG. 2), extending into the formation 14, and disposed in any orientation, such as the horizontal wellbore 12*b* illustrated in FIG. 2.

Drilling and production system 10 includes a drilling rig or derrick 20. Drilling rig 20 may include a hoisting apparatus 22, a travel block 24, and a swivel 26 for raising and lowering casing, drill pipe, coiled tubing, production tubing, other types of pipe or tubing strings or other types of conveyance vehicles, such as wireline, slickline, and the like 30. In FIG. 1, conveyance vehicle 30 is a substantially tubular, axially extending drill string formed of a plurality of drill pipe joints coupled together end-to-end, while in FIG. 2, conveyance vehicle 30 is completion tubing supporting a completion assembly as described below. Drilling rig 20 may include a kelly 32, a rotary table 34, and other equipment associated with rotation and/or translation of tubing string 30 within a wellbore 12. For some applications, drilling rig 20 may also include a top drive unit 36.

Drilling rig 20 may be located proximate to a wellhead 40 as shown in FIG. 1, or spaced apart from wellhead 40, such as in the case of an offshore arrangement as shown in FIG. 2. One or more pressure control devices 42, such as blowout preventers (BOPs) and other equipment associated with drilling or producing a wellbore may also be provided at wellhead 40 or elsewhere in the system 10.

For offshore operations, as shown in FIG. 2, whether drilling or production, drilling rig 20 may be mounted on an oil or gas platform 44, such as the offshore platform as illustrated, semi-submersibles, drill ships, and the like (not shown). Although system 10 of FIG. 2 is illustrated as being a marine-based production system, system 10 of FIG. 2 may be deployed on land. Likewise, although system 10 of FIG. 1 is illustrated as being a land-based drilling system, system 10 of FIG. 1 may be deployed offshore. In any event, for marine-based systems, one or more subsea conduits or risers 46 extend from deck 50 of platform 44 to a subsea wellhead 40. Tubing string 30 extends down from drilling rig 20, through subsea conduit 46 and BOP 42 into wellbore 12.

A working or service fluid source 52 may supply a working fluid 58 pumped to the upper end of tubing string 30 and flow through tubing string 30. Working fluid source 52 may supply any fluid utilized in wellbore operations, including without limitation, drilling fluid, cementious slurry, acidizing fluid, liquid water, steam or some other type of fluid.

Wellbore 12 may include subsurface equipment 54 disposed therein, such as, for example, a drill bit and bottom hole assembly (BHA), a completion assembly or some other type of wellbore tool.

Wellbore drilling and production system 10 may generally be characterized as having a pipe system 56. For purposes of this disclosure, pipe system 56 may include casing, risers, tubing, drill strings, completion or production strings, subs, heads or any other pipes, tubes or equipment that attaches to the foregoing, such as string 30 and conduit 46, as well as the wellbore and laterals in which the pipes, casing and strings may be deployed. In this regard, pipe system 56 may include one or more casing strings 60 cemented in wellbore 12, such as the surface, intermediate and production casing 60 shown in FIG. 1. An annulus 62 is formed between the walls of sets of adjacent tubular components, such as concentric casing strings 60 or the exterior of tubing string 30 and the inside wall of wellbore 12 or casing string 60, as the case may be.

Where subsurface equipment 54 is used for drilling and conveyance vehicle 30 is a drill string, the lower end of drill string 30 may include bottom hole assembly (BHA) 64, which may carry at a distal end a drill bit 66. During drilling operations, weigh-on-bit (WOB) is applied as drill bit 66 is rotated, thereby enabling drill bit 66 to engage formation 14 and drill wellbore 12 along a predetermined path toward a target zone. In general, drill bit 66 may be rotated with drill string 30 from rig 20 with top drive 36 or rotary table 34, and/or with a downhole mud motor 68 within BHA 64. The working fluid 58 may be pumped to the upper end of drill string 30 and flow through the longitudinal interior 70 of drill string 30, through bottom hole assembly 64, and exit from nozzles formed in drill bit 66. At bottom end 72 of wellbore 12, drilling fluid 58 may mix with formation cuttings, formation fluids and other downhole fluids and debris. The drilling fluid mixture may then flow upwardly through an annulus 62 to return formation cuttings and other downhole debris to the surface 16.

Bottom hole assembly 64 and/or drill string 30 may include various other tools, including a power source 69, mechanical subs 71 such as directional drilling subs, and measurement equipment 73, such as measurement while drilling (MWD) and/or logging while drilling (LWD) instruments, sensors, circuits, or other equipment to provide information about wellbore 12 and/or formation 14, such as logging or measurement data from wellbore 12. Measurement data and other information from the tools may be communicated using electrical signals, acoustic signals or other telemetry that can be converted to electrical signals at the rig 20 to, among other things, monitor the performance of drilling string 30, bottom hole assembly 64, and associated drill bit 66, as well as monitor the conditions of the environment to which the bottom hole assembly 64 is subjected.

With respect to FIG. 2 where subsurface equipment 54 is illustrated as completion equipment, disposed in a substantially horizontal portion of wellbore 12 is a lower completion assembly 74 that includes various tools such as an orientation and alignment subassembly 76, a packer 78, a sand control screen assembly 110, a packer 112, a sand control screen assembly 114, a packer 116, a sand control screen assembly 118 and a packer 120.

Extending downhole from lower completion assembly 74 is one or more communication cables 122, such as a sensor or electric cable, that passes through packers 78, 112 and 116 and is operably associated with one or more electrical devices 124 associated with lower completion assembly 74, such as sensors position adjacent sand control screen assemblies 110, 114, 118 or at the sand face of formation 14, or downhole controllers or actuators used to operate downhole tools or fluid flow control devices. Cable 122 may operate as communication media, to transmit power, or data and the like between lower completion assembly 74 and an upper completion assembly 125.

In this regard, disposed in wellbore 12 at the lower end of tubing string 30 is an upper completion assembly 125 that includes various tools such as a packer 126, an expansion joint 128, a packer 100, a fluid flow control module 102 and an anchor assembly 104.

Extending uphole from upper completion assembly 125 are one or more communication cables 106, such as a sensor cable or an electric cable, which passes through packers 126, 100 and extends to the surface 16. Cable 106 may operate as communication media, to transmit power, or data and the like between a surface controller (not pictured) and the upper and lower completion assemblies 125, 74.

Shown deployed in FIG. 1 and FIG. 2 is an electromagnetic (EM) telemetry system 80 using capacitive electrodes according to some embodiments. In one or more embodiments, EM telemetry system 80 includes a surface assembly 81 having a counter electrode 83 and a downhole transceiver 89. EM telemetry system 80 allows for communication between surface assembly 81 and downhole transceiver 89. For example, EM telemetry system 80 may allow communication between a control and/or data acquisition module coupled to surface assembly 81 and downhole equipment and/or sensor(s) coupled to downhole transceiver 89. In one or more embodiments, EM telemetry system 80 may be bidirectional; that is, one or both of surface assembly 81 and downhole transceiver 89 may be configured as a transmitter and/or receiver of EM telemetry system 80 at a given time. In furtherance of such embodiments, any suitable duplexing technique may be utilized, such as time division duplexing, frequency division duplexing, and/or the like. In one or more embodiments, EM telemetry system 80 may be unidirectional.

Encoded signal 90, as depicted in FIG. 1 and FIG. 2, is a time-varying electromagnetic field that carries information between surface assembly 81 and downhole transceiver 89. For example, encoded signal 90 may carry measurement and/or logging data acquired by one or more downhole tools, the data being transmitted to the surface for further processing. Because encoded signal 90 may be transmitted and received during drilling operation, EM telemetry system 80 is suitable for drilling, measurement-while-drilling (MWD) and/or logging-while-drilling applications. For example, the encoded signal 90 may carry measurement data, logging data, and/or instructions for drilling tools, such as directions used for directional drilling applications. In one or more embodiments, the information carried by encoded signal 90 may be in a digital and/or analog format. Accordingly, any suitable digital and/or analog encoding and/or modulation schemes may be employed to achieve reliable, secure, and/or high speed communication between downhole transceiver 89 and surface assembly 81. In one or more embodiments, the encoding and modulation scheme may include pulse width modulation, pulse position modulation, on-off keying, amplitude modulation, frequency modulation, single-side-band modulation, frequency shift keying, phase shift keying (e.g., binary phase shift keying and/or M-ary phase shift keying), discrete multi-tone, orthogonal frequency division multiplexing, and/or the like. In one or more embodiments, encoded signal 90 may have a frequency range between 1 Hz and 50 Hz and a nominal data rate of between 3 and 12 bits per second.

When EM telemetry system 80 operates with downhole transceiver 89 as the transmitter and surface assembly 81 as the receiver, encoded signal 90 is generated by applying a voltage signal across a gap in downhole transceiver 89. For example, the gap may electrically insulate drill bit 66 from drill string 30. More generally, the gap electrically insulates a portion of system 10 that is electrically coupled to wellhead 40 from a portion of system 10 that is electrically coupled to formation 14. In one or more embodiments, the applied voltage signal may have a strength of approximately 3 V (e.g., nominally between 0.5 and 5 V). Encoded signal 90 propagates through the earth and drill string 30 to surface assembly 81. At the surface, counter electrode 83 measures a voltage signal corresponding to encoded signal 90, the voltage signal being determined based on a differential voltage between counter electrode 83 and wellhead 40. The measured voltage signal is demodulated and/or decoded to recover the information carried by encoded signal 90. In one or more embodiments, the measured voltage signal may have a strength of approximately 10 μV. Similarly, when EM telemetry system 80 operates with surface assembly 81 as the transmitter and downhole transceiver 89 as the receiver of encoded signal 90, encoded signal 90 is transmitted by applying a voltage signal between counter electrode 83 and wellhead 40. A corresponding voltage signal across the gap in downhole transceiver is measured, demodulated, and/or decoded to recover the information carried by encoded signal 90.

Although encoded signal 90 is ideally transmitted and received without noise, in practice the received voltage signal is noisy. One source of noise in EM telemetry system 80 is telluric noise, which is depicted in FIGS. 1 and 2 as a telluric noise signal 92. Telluric noise is induced by telluric currents induced by geomagnetic pulsations and/or atmospheric pulsations (e.g., lightning and/or sferics). Telluric currents span a wide range of frequencies. Telluric currents from geomagnetic pulsations span frequencies from 1 mHz to a few Hz (e.g., 1 mHz to 10 Hz), and atmospheric pulsations span frequencies above 1 Hz (e.g., 100 Hz). The magnetic fields associated with telluric currents are known to be spatially slowly varying, and may be assumed to be constant, or approximately constant, over a large distance (e.g., at least 10 km).

Because telluric currents are spatially slowly varying, one approach to mitigating telluric noise is to utilize telluric referencing techniques. In telluric referencing, a signal of interest, such as encoded signal 90, is detected at one location and a reference signal, such as reference signal 94, is measured at a distance far away from this location. The detected signal and reference signal are synchronized and the reference signal (and/or a transfer function of the reference signal) is subtracted from the detected signal. The resulting signal is nearly free from telluric noise to the extent that approximately the same telluric noise signal appears in both the detected signal and the reference signal and is therefore canceled out during the subtraction operation. Telluric referencing to mitigate telluric noise has been employed, for example, in induced polarization applications. In induced polarization applications, however, the signal of interest is a periodic alternating current (AC) signal that does not carry any encoded information between a downhole and surface component of a wellbore.

In order to achieve telluric referencing in EM telemetry system 80, reference assembly 85 is provided at a location far away from surface assembly 81 and downhole transceiver 89. Sensor 87 of reference assembly 85 is configured to measure a reference signal 94 based on one or more components of the electromagnetic fields induced by telluric currents. In one or more embodiments, sensor 87 may be configured to measure a strength and/or direction of the magnetic field induced by the telluric currents. In one or more embodiments, sensor 87 may be configured to measure components of the induced magnetic field that are parallel to the surface of the earth. In one or more embodiments, sensor 87 may be configured to measure components of both the induced magnetic field and the induced electric field. In one or more embodiments, reference assembly 85 may include synchronization and/or communication capabilities in order to transmit the reference signal 94 to surface assembly 81, as discussed below with respect to FIG. 5.

In one or more embodiments, reference assembly 85 may be positioned approximately 10 km (e.g., between 5 km and 20 km) from surface assembly 81. Positioning reference assembly 85 at this relatively large distance from surface assembly 81 exploits the fact that magnetic fields induced by telluric currents are known to be spatially slowly varying and may be assumed to be constant, or approximately constant, over a distance of many kilometers. Positioning reference assembly 85 at a relatively large distance from surface assembly 81 provides several advantages, including permitting downhole transceiver 89 to move over large lateral distances within the earth (e.g., up to 5 km for a long reaching horizontal well) and reducing correlation between encoded signal 90 and the reference signal 94 measured by reference assembly 85. That is, because the reference signal 94 is subtracted from the received encoded signal 90, it is undesirable for the reference signal 94 to be correlated with encoded signal 90.

Figure 3:
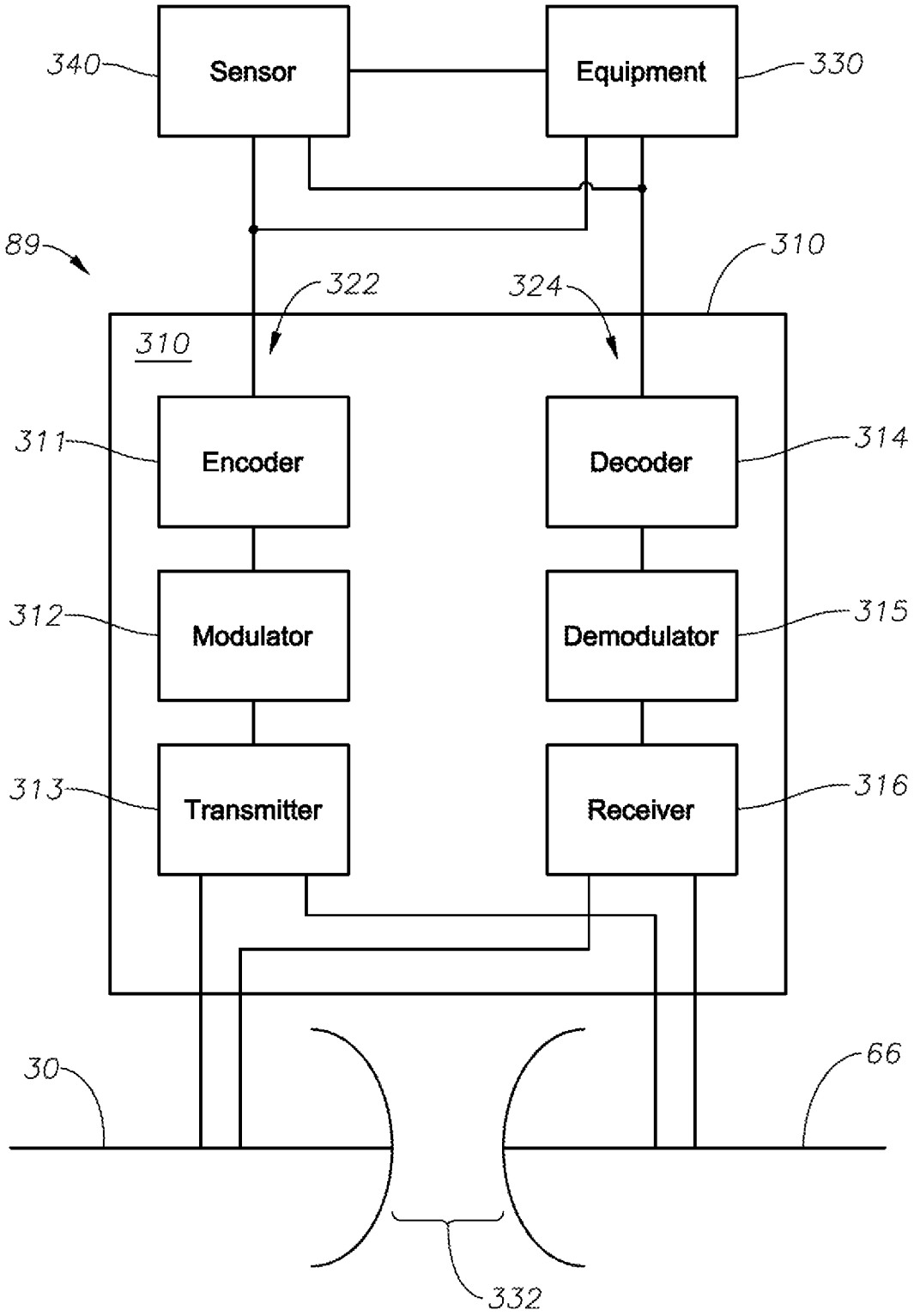
FIG. 3 is a plan view of a downhole transceiver of an EM telemetry system of the disclosure.

Although downhole transceiver 89 is not limited to a particular type or configuration, FIG. 3 illustrates one embodiment of downhole transceiver 89. In one or more embodiments, downhole transceiver 89 may be configured as an encoded signal transmitter of EM telemetry system 80. In furtherance of such embodiments, downhole transceiver 89 may include a controller 310 that includes an encoder 311, a modulator 312, and a transmitter 313. In one or more embodiments, downhole transceiver 89 may be additionally and/or alternately configured as an encoded signal receiver of EM telemetry system 80. In furtherance of such embodiments, controller 310 may include a decoder 314, a demodulator 315, and a receiver 316. In one or more embodiments, encoder 311 may be coupled to one or more downhole data sources, such downhole equipment 330 and/or a downhole sensor 340, and may receive analog and/or digital data from said data sources over input interface 322. Encoder 311 may convert the received data into a stream of bits, modulator 312 may convert the stream of bits into analog and/or digital symbols, and transmitter 313 may convert the symbols into a voltage signal corresponding to encoded signal 90. In one or more embodiments, encoder 311 may perform various operations on the incoming data including source encoding, interleaving, encryption, channel encoding, convolutional encoding, and/or the like. In one or more embodiments, modulator 312 may modulate the incoming stream of bits according to a variety of modulation schemes including pulse width modulation, pulse position modulation, on-off keying, amplitude modulation, frequency modulation, single-side-band modulation, frequency shift keying, phase shift keying (e.g., binary phase shift keying and/or M-ary phase shift keying), discrete multi-tone, orthogonal frequency division multiplexing, and/or the like. The voltage signal is applied between a gap 332 in downhole transceiver 89. As depicted in FIG. 3, gap 332 electrically insulates drill bit 66 from drill string 30 in accordance with FIG. 1. However, it is to be understood that gap 332 may separate other downhole components, such as wireline 30 from upper completion assembly 125 as depicted in FIG. 2. Analogously, where downhole transceiver 89 is configured as a receiver of EM telemetry system 80, decoder 314, demodulator 315, and receiver 316 may operate to measure a voltage signal across gap 332 and demodulate/decode the measured voltage signal to provide output analog and/or digital data to one or more downhole tools over output interface 324.

In one or more embodiments, downhole sensor 340 may be associated with, coupled to, and/or otherwise disposed to monitor downhole equipment 330 and may transmit information (e.g., measurement and/or logging data) associated with downhole equipment 330 to surface assembly 81 through controller 310. In one or more embodiments, downhole equipment 330 may receive instructions from surface assembly 81 through controller 310. In some embodiments, downhole equipment 330 may include drilling equipment, logging-while-drilling (LWD) equipment, measurement-while-drilling (MWD) equipment, production equipment, and/or the like. In some embodiments, downhole sensor 340 may include one or more temperature sensors, pressure sensors, strain sensors, pH sensors, density sensors, viscosity sensors, chemical composition sensors, radioactive sensors, resistivity sensors, acoustic sensors, potential sensors, mechanical sensors, nuclear magnetic resonance logging sensors, gravity sensor, a pressure sensor, a fixed length line sensor, optical tracking sensor, a fluid metering sensor, an acceleration integration sensor, a velocity timing sensor, an odometer, a magnetic feature tracking sensor, an optical feature tracking sensor, an electrical feature tracking sensor, an acoustic feature tracking sensor, a dead reckoning sensor, a formation sensor, an orientation sensor, an impedance type sensor, a diameter sensor, and/or the like.

Figure 4:
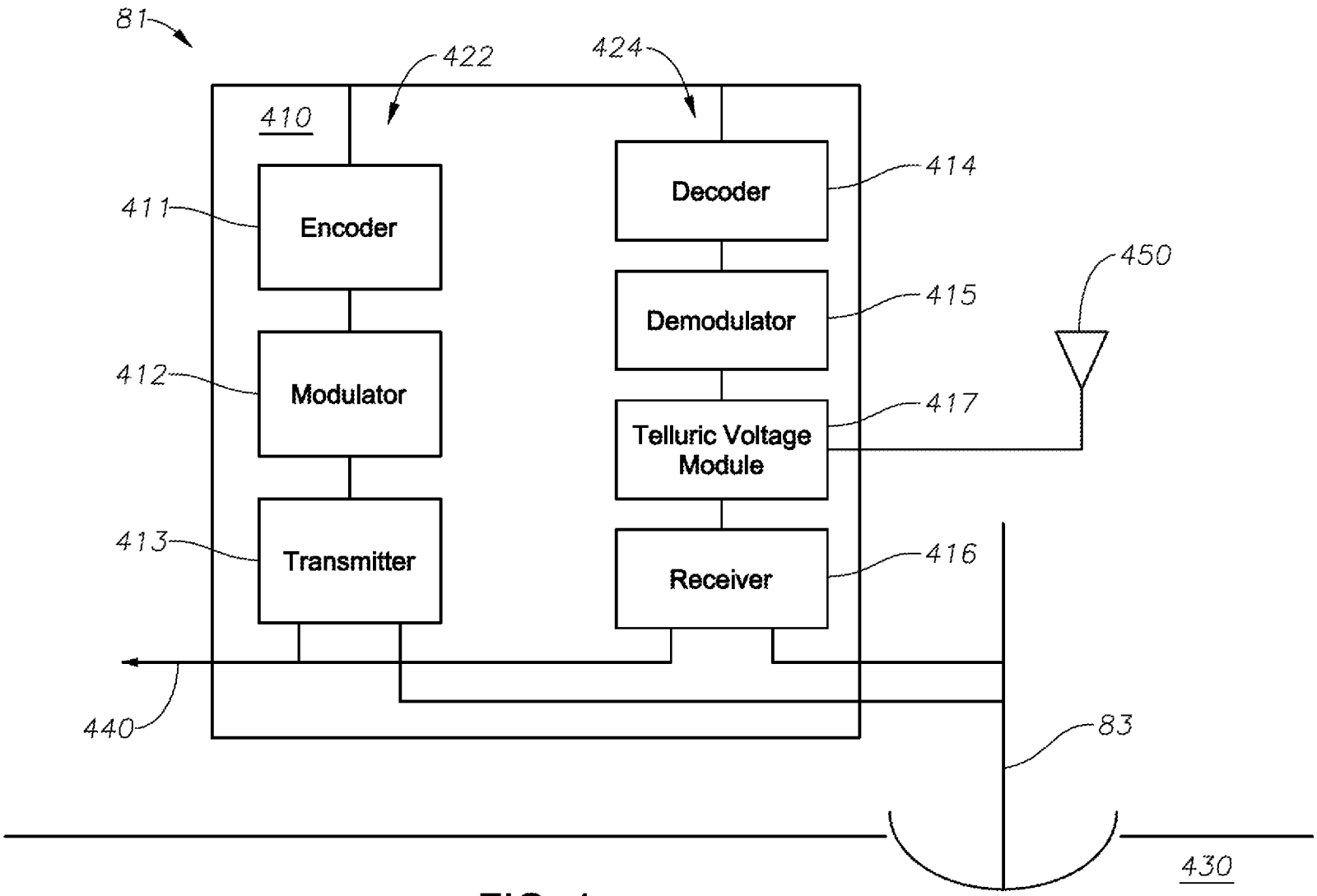
FIG. 4 is a plan view of a surface assembly of an EM telemetry system of the disclosure.

Although surface assembly 81 is not limited to a particular type or configuration, FIG. 4 illustrates one embodiment of surface assembly 81. In one or more embodiments, surface assembly 81 may be configured as an encoded signal transmitter of EM telemetry system 80. In furtherance of such embodiments, surface assembly 81 may include a controller 410 that includes an encoder 411, a modulator 412, and a transmitter 413, as described above with respect to FIG. 3. In one or more embodiments, surface assembly 81 may be additionally and/or alternately configured as an encoded signal receiver of EM telemetry system 80. In furtherance of such embodiments, surface assembly 81 may include a controller 410 that includes a decoder 414, a demodulator 415, and/or a receiver 416. The functions performed by decoder 414, demodulator 415, and receiver 416 on the received data generally mirror the functions performed by encoder 311, modulator 312, and transmitter 313 depicted in FIG. 3. Thus, for example, decoder 414 may perform source decoding, de-interleaving, channel decoding, convolutional decoding, and/or the like. Controller 410 may further include an input interface 422 and an output interface 424 for communicating transmitted or received data, respectively, to and from various data sources or sinks, such as a control and/or data collection module, a user interface, and/or the like.

Surface assembly 81 includes a counter electrode 83. Counter electrode 83 is used by transmitter 413 and/or receiver 416 to measure a voltage signal corresponding to encoded signal 90. Counter electrode 83 is used by transmitter 413 and/or receiver 416 to measure and/or apply a voltage signal between counter electrode 83 and wellhead 40. A wire 440 couples controller 410 to wellhead 40 such that a potential difference between counter electrode 83 and wellhead 40 may be applied by transmitter 413 and/or measured by receiver 416. In some embodiments, counter electrode 83 is placed ten or more meters from wellhead 40. In one or more embodiments, counter electrode 83 may electrically couple to the earth formation 430 and/or fluids therein using any suitable coupling mechanism, such as galvanic coupling, capacitive coupling, and/or the like. For example, a galvanic counter electrode may include a metal stake, a porous pot, an abandoned well head or oil rig, and/or the like that electrically couples to the earth through electrochemical reactions. A capacitive counter electrode may include a capacitor plate (e.g., a metal plate) coated with an electrically insulating barrier layer (e.g., an oxidized and/or anodized surface) that electrically couples to the earth formation 430 through electric fields formed across the barrier layer. In some examples, counter electrode 83 may include a plurality of galvanic and/or capacitive counter electrodes that are arranged so as to improve SNR, reliability (e.g., by providing redundancy), and/or the like.

In one or more embodiments, surface assembly 81 may include and/or be coupled to a telluric voltage module 417 for conditioning the voltage signal received by counter electrode 83. In one or more embodiments, telluric voltage module 417 may include one or more analog and/or digital signal processors, memory modules, storage modules, and/or communication interfaces, such as an antenna 450 for communicating with reference assembly 85. In one or more embodiments, telluric voltage module 417 may include a synchronization module for synchronizing with reference assembly 85, as discussed below with respect to FIG. 5. In one or more embodiments, telluric voltage module 417 may be configured to receive a detected signal from receiver 416, such as encoded signal 90, which includes desirable encoded information and undesirable telluric noise 92. Telluric voltage module 417 may further be configured to receive a reference signal 94 from reference assembly 85, the reference signal 94 being associated with the telluric noise 92. In furtherance of such embodiments, telluric voltage module 417 may be configured to synchronize the encoded signal 90 and the reference signal 94 and subtract the reference signal 94 (and/or a transfer function of the reference signal) from the encoded signal 90. The resulting signal is nearly free from telluric noise to the extent that approximately the same telluric noise signal 92 appears in both the encoded signal 90 and the reference signal 94 and is, therefore, canceled out during the subtraction operation. Telluric voltage module 417 may output the resulting signal to demodulator 415 and/or decoder 414 to recover information (e.g., data from a MWD or LWD tool and/or instructions from a directional drilling tool) carried by the received encoded signal 90. Although telluric voltage module 417 is depicted as being included in surface assembly 81, it is to be understood that telluric voltage module 417 may be spaced apart from surface assembly 81, coupled to and/or included in reference assembly 85, and/or otherwise suitably disposed in EM telemetry system 80.

Figure 5:
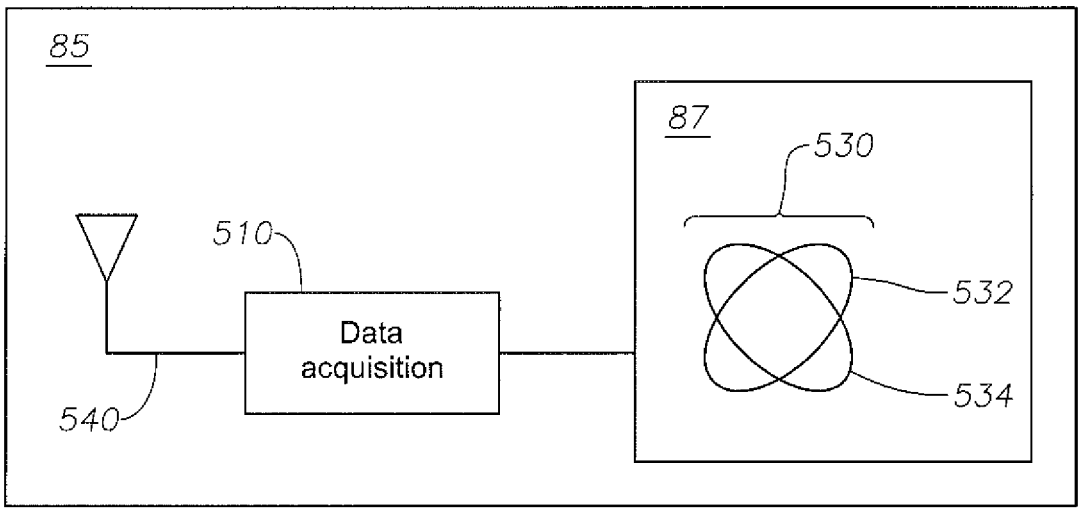
FIG. 5 is a plan view of a reference assembly of an EM telemetry system of the disclosure.

Although reference assembly 85 is not limited to a particular type or configuration, FIG. 5 illustrates one embodiment of reference assembly 85. In one or more embodiments, reference assembly 85 may be configured as reference receiver of EM telemetry system 80. In furtherance of such embodiments, reference assembly 85 may include a sensor 87 that includes one or more magnetic field sensors 530. As depicted in FIG. 5, magnetic field sensors 530 are configured as an orthogonal pair of horizontal magnetic field sensors. That is, a first magnetic field sensor 532 measures a first magnetic field component parallel to the surface of the earth along a first axis, and a second magnetic field sensor 534 measures a second magnetic field component, also parallel to the surface of the earth but along a second axis perpendicular to the first axis. Magnetic field sensors 530 may include any suitable devices for sensing magnetic fields along one or more axes, including induction sensors, magnetometers, and/or the like. In one or more embodiments, reference assembly 85 may include a data acquisition module 510. Data acquisition module 510 is coupled to sensor 87 to receive and process signals from magnetic field sensors 530 and/or the like and generate a reference signal. For example, data acquisition module 510 may include one or more analog and/or digital signal processors, memory modules, storage modules, and/or communication interfaces, such as antenna 540 for communicating with surface assembly 81. In one or more embodiments, reference assembly 85 may include a synchronization module for synchronizing with surface assembly 81, such as controller 410 of surface assembly 81 depicted in FIG. 4. The synchronization module may be configured to implement global positioning system (GPS) synchronization, cable-based synchronization, wireless synchronization, and/or the like. In one or more embodiments, reference assembly 85 may be coupled to communicate with surface assembly 81 via a wireless link, such as a satellite link or radio link (e.g., 2G, 3G, GSM, and/or CDMA radio links), a cable link (e.g., Ethernet links), and/or the like. In one or more embodiments, the communication link may be used for real-time transmission of the reference signal to surface assembly 81.

Figure 6:
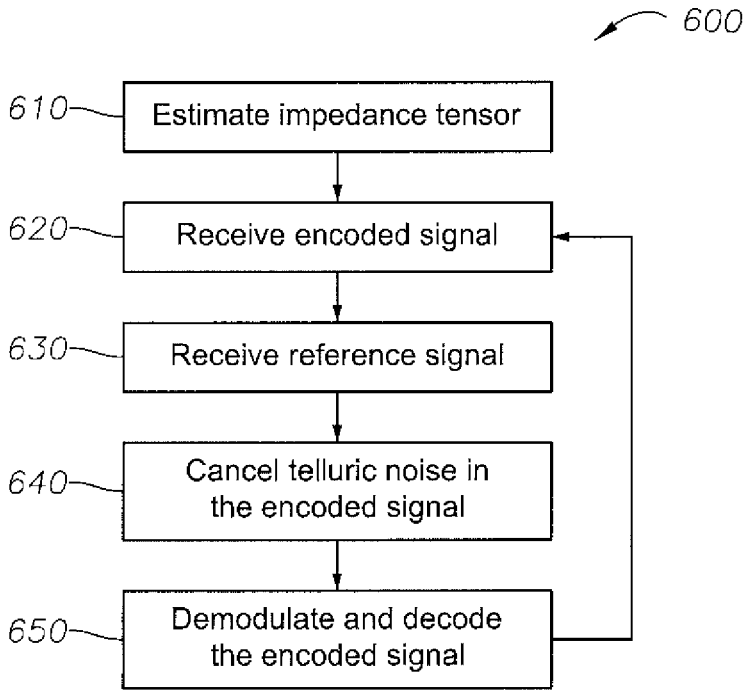
FIG. 6 is a flowchart of a method of EM telemetry using telluric referencing.

FIG. 6 shows a simplified diagram of a method 600 of EM telemetry using telluric referencing according to some embodiments. According to some embodiments consistent with FIGS. 1-5, EM telemetry system 80 may perform method 600 in order to mitigate interference caused by telluric noise. More specifically, a telluric voltage module, such as telluric voltage module 417 depicted in FIG. 4, may perform method 600 when the surface assembly is configured to receive an encoded signal transmitted by a downhole transceiver, such as downhole transceiver 89.

At step 610, an impedance tensor is estimated. In one or more embodiments, the impedance tensor is a frequency-domain impedance tensor and is estimated from the time-frequency processing and analysis of telluric electric and magnetic field time series data. The impedance tensor characterizes the relationship between the frequency-domain telluric magnetic field measured by a reference assembly, such as reference assembly 85, and a frequency-domain telluric electric field between a counter electrode, such as counter electrode 83, and a wellhead, such as wellhead 40. More specifically, the impedance tensor with elements $Z_{ij}$ relates the telluric magnetic field at the reference assembly $H_j^r$ to the telluric electric field $E_i^t$, according to the following equation:

$$E_i^t = Z_{ij} H_j^r$$

The telluric electric field $E_i^t$, is related to the telluric voltage signal $V^t$ measured between the counter electrode 83 and wellhead 40 according to the following equation:

$$V^t = E_i^t l$$

In the above equation, l is the distance between the counter electrode 83 and wellhead 40. In one or more embodiments, the impedance tensor may be estimated or calculated prior to the transmission of an encoded signal 90.

In one or more embodiments, the impedance tensor may be estimated by concurrently measuring the telluric voltage signal $V^t$ and the magnetic field at the reference assembly 85 in the absence of transmitting or receiving an encoded signal. Based on the concurrently measured data, the impedance tensor elements $Z_{ij}$ may be estimated using from the time-frequency processing and analysis of telluric electric and magnetic field time series data. (See, e.g., K. Vozoff, *The Magnetotelluric Method in the Exploration of Sedimentary Basins*, Geophysics, vol. 37, no. 1, pp. 98-141 (1972).)

At step 620, an encoded signal 90 is received. In one or more embodiments, the received encoded signal corresponds to a voltage $V^m$ measured between the counter electrode 83 and wellhead 40 during transmission of the encoded signal 90. In one or more embodiments, the voltage signal $V^m$ may be measured in the presence of one or more noise signals 92 including a telluric noise signal $V^t$. The measured voltage signal may be represented in analog and/or digital format. The measured voltage signal is characterized by a signal-to-noise ratio (SNR) measured by dividing the strength of the encoded signal 90 by the strength of the various noise signals 92.

At step 630, a reference signal 94 is received from a reference assembly, such as reference assembly 85. In one or more embodiments, the reference signal 94 may be based upon a measurement and time-frequency processing and analysis of the strength and direction of a magnetic field at the reference assembly $H_j^T$. The reference signal 94 may be received over a wireless or wired link. The reference signal 94 may be represented in an analog and/or digital format. In one or more embodiments, the reference signal 94 may include a measurement of the two-dimensional component of the magnetic field parallel to the surface of the earth. The timing of the reference signal 94 received during step 630 may be synchronized with the voltage $V^m$ received during step 620 using any suitable synchronization technique, such as GPS synchronization techniques as discussed previously.

At step 640, telluric noise 92 in the received encoded signal 90 is cancelled using the reference signal 94. In one or more embodiments, the reference signal 94 is converted to a telluric voltage signal $V^t$ and subtracted from the measured voltage signal $V^m$. In one or more examples, where the reference signal 94 includes a measurement of the magnetic field at the reference assembly $H_j^T$, the reference signal 94 is converted to $V^t$ by multiplying $H_j^r$ by the impedance tensor elements $Z_{ij}$ and scaling by the distance l using the equations discussed previously with respect to step 610. The output of process 640 is a denoised voltage signal $V^d$ calculated according to the following equation:

$$V^d = V^m - V^t$$

In general, the denoised voltage signal $V^d$ has an improved SNR relative to the measured voltage signal $V^m$ because the telluric noise signal $V^t$ has been at least partially cancelled. For example, the telluric noise signal strength may be between 1 μV and 100 μV at the frequencies of interest (i.e., the frequency of the encoded signal, which in some embodiments may be between 1 Hz and 50 Hz), while the encoded signal strength at the surface 16 may be less than 1 mV. Accordingly, subtracting the reference signal 94 may offer large SNR improvements of 10% or greater relative to EM telemetry systems that do not employ telluric noise cancellation techniques.

At step 650, the denoised voltage signal $V^d$ is demodulated and decoded to recover the information carried in the encoded signal 90. Due to the telluric noise cancellation at step 640, the denoised voltage signal $V^d$ has an improved SNR relative to the original measured voltage signal. Accordingly, in one or more embodiments, the demodulator and decoder operated in accordance with method 600 may generate output data more reliably and/or faster than conventional EM telemetry systems. The demodulation and decoding processes generally mirror the processing steps applied by the downhole transceiver to generate the encoded signal 90. In one or more embodiments, the encoding and modulation scheme (and corresponding decoding and demodulation scheme) may include pulse width modulation, pulse position modulation, on-off keying, amplitude modulation, frequency modulation, single-side-band modulation, frequency shift keying, phase shift keying (e.g., binary phase shift keying and/or M-ary phase shift keying), discrete multi-tone, orthogonal frequency division multiplexing, and/or the like. In one or more embodiments, steps 620-650 may be continuously performed (e.g., sequentially performed in a loop and/or concurrently performed) to continuously receive data using the EM telemetry system 80 with telluric referencing.

Any one of the foregoing methods may be particularly useful during various procedures in a wellbore. Thus, in one or more embodiments, a wellbore may be drilled, and during drilling or during a suspension in drilling, information about downhole equipment disposed in the wellbore may be generated. The downhole equipment may be selected from the group consisting of drilling equipment, logging-while-drilling (LWD) equipment, measurement-while-drilling (MWD) equipment and production equipment. Likewise, in one or more embodiments, downhole production equipment may be disposed in a wellbore, and during production operations, information about downhole equipment disposed in the wellbore may be generated. The information may be generated utilizing one or more sensors disposed in the wellbore and selected from the group consisting of temperature sensors, pressure sensors, strain sensors, pH sensors, density sensors, viscosity sensors, chemical composition sensors, radioactive sensors, resistivity sensors, acoustic sensors, potential sensors, mechanical sensors, nuclear magnetic resonance logging sensors, gravity sensor, a pressure sensor, a fixed length line sensor, optical tracking sensor, a fluid metering sensor, an acceleration integration sensor, a velocity timing sensor, an odometer, a magnetic feature tracking sensor, an optical feature tracking sensor, an electrical feature tracking sensor, an acoustic feature tracking sensor, a dead reckoning sensor, a formation sensor, an orientation sensor, an impedance type sensor, and a diameter sensor.

Figure 7:
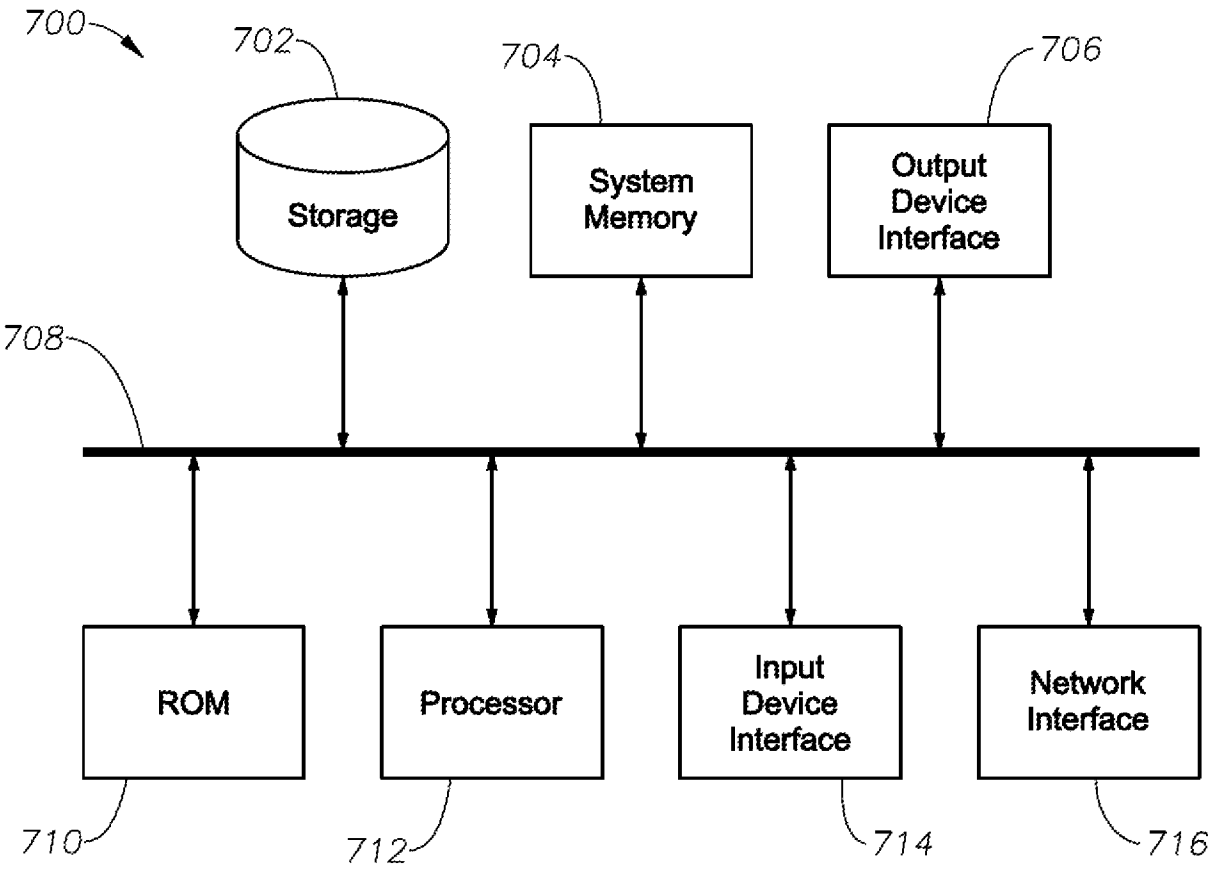
FIG. 7 is a block diagram of a computer of an EM telemetry system of the disclosure.

FIG. 7 is a block diagram of an exemplary computer system 700 in which embodiments of the present disclosure may be adapted for performing EM telemetry using telluric referencing. For example, the steps of the operations of method 600 of FIG. 6 and/or the components of controller 310 of FIG. 3, controller 410 and/or telluric voltage module 417 of FIG. 4, as described above, may be implemented using system 700. System 700 can be a computer, phone, personal digital assistant (PDA), or any other type of electronic device. Such an electronic device includes various types of computer readable media and interfaces for various other types of computer readable media. As shown in FIG. 7, system 700 includes a permanent storage device 702, a system memory 704, an output device interface 706, a system communications bus 708, a read-only memory (ROM) 710, processing unit(s) 712, an input device interface 714, and a network interface 716.

Bus 708 collectively represents all system, peripheral, and chipset buses that communicatively connect the numerous internal devices of system 700. For instance, bus 708 communicatively connects processing unit(s) 712 with ROM 710, system memory 704, and permanent storage device 702.

From these various memory units, processing unit(s) 712 retrieves instructions to execute and data to process in order to execute the processes of the subject disclosure. The processing unit(s) can be a single processor or a multi-core processor in different implementations.

ROM 710 stores static data and instructions that are needed by processing unit(s) 712 and other modules of system 700. Permanent storage device 702, on the other hand, is a read-and-write memory device. This device is a non-volatile memory unit that stores instructions and data even when system 700 is off. Some implementations of the subject disclosure use a mass-storage device (such as a magnetic or optical disk and its corresponding disk drive) as permanent storage device 702.

Other implementations use a removable storage device (such as a floppy disk, flash drive, and its corresponding disk drive) as permanent storage device 702. Like permanent storage device 702, system memory 704 is a read-and-write memory device. However, unlike storage device 702, system memory 704 is a volatile read-and-write memory, such a random access memory (RAM). System memory 704 stores some of the instructions and data that the processor needs at runtime. In some implementations, the processes of the subject disclosure are stored in system memory 704, permanent storage device 702, and/or ROM 710. For example, the various memory units include instructions for computer aided pipe string design based on existing string designs in accordance with some implementations. From these various memory units, processing unit(s) 712 retrieves instructions to execute and data to process in order to execute the processes of some implementations.

Bus 708 also connects to input and output device interfaces 714 and 706, respectively. Input device interface 714 enables the user to communicate information and select commands to system 700. Input devices used with input device interface 714 include, for example, alphanumeric, QWERTY, or T9 keyboards, microphones, and pointing devices (also called "cursor control devices"). Output device interfaces 706 enables, for example, the display of images generated by system 700. Output devices used with output device interface 706 include, for example, printers and display devices, such as cathode ray tubes (CRT) or liquid crystal displays (LCD). Some implementations include devices such as a touchscreen that functions as both input and output devices. It should be appreciated that embodiments of the present disclosure may be implemented using a computer including any of various types of input and output devices for enabling interaction with a user. Such interaction may include feedback to or from the user in different forms of sensory feedback including, but not limited to, visual feedback, auditory feedback, or tactile feedback. Further, input from the user can be received in any form including, but not limited to, acoustic, speech, or tactile input. Additionally, interaction with the user may include transmitting and receiving different types of information, e.g., in the form of documents, to and from the user via the above-described interfaces.

Also, as shown in FIG. 7, bus 708 also couples system 700 to a public or private network (not shown) or combination of networks through a network interface 716. Such a network may include, for example, a local area network (LAN), such as an Intranet, or a wide area network (WAN), such as the Internet. Any or all components of system 700 can be used in conjunction with the subject disclosure.

These functions described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, read-only and recordable Blu-Ray® discs, ultra density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself. Accordingly, the steps of the operations of method 600 of FIG. 6, as described above, may be implemented using system 700 or any computer system having processing circuitry or a computer program product including instructions stored therein, which, when executed by at least one processor, causes the processor to perform functions relating to these methods.

As used in this specification and any claims of this application, the terms "computer," "server," "processor," and "memory" all refer to electronic or other technological devices. These terms exclude people or groups of people. As used herein, the terms "computer readable medium" and "computer readable media" refer generally to tangible, physical, and non-transitory electronic storage mediums that store information in a form that is readable by a computer.

Embodiments of the subject matter described in this specification can be implemented in a computing system that includes a back end component, e.g., a data server; a middleware component, e.g., an application server; a front end component, e.g., a client computer having a graphical user interface or a Web browser through which a user can interact with an implementation of the subject matter described in this specification; or any combination of one or more such back end, middleware, or front end components. The components of the system can be interconnected by any form or medium of digital data communication, e.g., a communication network. Examples of communication networks include a local area network (LAN) and a wide area network (WAN), an inter-network (e.g., the Internet), and peer-to-peer networks (e.g., ad hoc peer-to-peer networks).

The computing system can include clients and servers. A client and server are generally remote from each other and typically interact through a communication network. The relationship of client and server arises by virtue of computer programs running on the respective computers and having a client-server relationship to each other. In some embodiments, a server transmits data (e.g., a web page) to a client device (e.g., for purposes of displaying data to and receiving user input from a user interacting with the client device). Data generated at the client device (e.g., a result of the user interaction) can be received from the client device at the server.

It is understood that any specific order or hierarchy of steps in the processes disclosed is an illustration of exemplary approaches. Based upon design preferences, it is understood that the specific order or hierarchy of steps in the processes may be rearranged, or that all illustrated steps be performed. Some of the steps may be performed simultaneously. For example, in certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Furthermore, the exemplary methodologies described herein may be implemented by a system including processing circuitry or a computer program product including instructions which, when executed by at least one processor, causes the processor to perform any of the methodology described herein.

Thus, an EM telemetry system with telluric referencing has been described. Embodiments of an EM telemetry system with telluric referencing for use with downhole equipment include a downhole transceiver comprising an encoded signal transmitter, a downhole sensor disposed to monitor the downhole equipment, the downhole sensor coupled to the transceiver, an encoded signal receiver, a reference receiver spaced apart from the encoded signal receiver and communicatively coupled to the encoded signal receiver, and a telluric voltage module coupled to one of the encoded signal receiver or the reference receiver. Likewise, an electromagnetic (EM) telemetry system for use with downhole equipment in a wellbore extending from a surface has been described and may generally include a sensor positioned in the wellbore and disposed to monitor the downhole equipment, a downhole transceiver disposed in the wellbore, the downhole transceiver comprising an encoded signal transmitter, an encoded signal receiver disposed adjacent the surface, a reference receiver disposed adjacent the surface and spaced apart from the encoded signal receiver, the reference receiver communicatively coupled to the encoded signal receiver, and a telluric voltage module coupled to one of the encoded signal receiver or the reference receiver.

For any of the foregoing embodiments the system may include any one of the following elements, alone or in combination with each other: the downhole equipment is selected from the group consisting of drilling equipment, logging-while-drilling (LWD) equipment, measurement-while-drilling (MWD) equipment and production equipment; the sensor is selected from the group consisting of temperature sensors, pressure sensors, strain sensors, pH sensors, density sensors, viscosity sensors, chemical composition sensors, radioactive sensors, resistivity sensors, acoustic sensors, potential sensors, mechanical sensors, nuclear magnetic resonance logging sensors, gravity sensor, a pressure sensor, a fixed length line sensor, optical tracking sensor, a fluid metering sensor, an acceleration integration sensor, a velocity timing sensor, an odometer, a magnetic feature tracking sensor, an optical feature tracking sensor, an electrical feature tracking sensor, an acoustic feature tracking sensor, a dead reckoning sensor, a formation sensor, an orientation sensor, an impedance type sensor, and a diameter sensor; the reference receiver is communicatively coupled to the encoded signal receiver by a wireless communications transmitter; the reference receiver is communicatively coupled to the encoded signal receiver by a cable; the reference receiver is spaced approximately 10 km from the encoded signal receiver; the reference receiver is spaced between 5 km and 20 km from the encoded signal receiver; the reference receiver is synchronized with the encoded signal receiver using global positioning system (GPS) synchronization; the encoded signal receiver is coupled to a counter electrode; the counter electrode includes a galvanic electrode; the counter electrode includes a capacitive electrode; an encoded signal comprising sensor information related to the downhole equipment; the encoded signal is encoded using at least one of pulse width modulation, pulse position modulation, on-off keying, amplitude modulation, frequency modulation, single-side-band modulation, frequency shift keying, phase shift keying, discrete multi-tone, and orthogonal frequency division multiplexing; a reference signal comprising sensor information related to a telluric current; the reference signal is determined based on a strength and direction of a magnetic field induced by the telluric current; the reference signal is determined based on the strength and direction of the magnetic field in a two-dimensional plane parallel to an earth surface plane; the reference receiver is coupled to a crossed pair of magnetic field sensors; the reference receiver is coupled to one or more inductive sensors; the reference receiver is coupled to one or more magnetometers; the reference signal is multiplied by an impedance tensor and scaled by a distance between the surface assembly and a wellhead to determine a telluric voltage signal; the impedance tensor is estimated prior to transmitting and receiving the encoded signal; the telluric voltage module subtracts the telluric voltage signal from the encoded signal to cancel telluric noise in the encoded signal.

A method for receiving information from a downhole transceiver has been described. Embodiments of the method may include receiving an encoded signal, receiving a reference signal, cancelling telluric noise in the received encoded signal using the reference signal, and recovering the information from the encoded signal. The encoded signal is measured at a first location, and the reference signal is measured synchronously with the encoded signal at a second location spaced apart from the first location. Other embodiments of the method may include monitoring downhole equipment in a wellbore, generating information about the downhole equipment, transmitting an encoded signal including the generated information, receiving the encoded signal, receiving a reference signal, cancelling telluric noise in the received encoded signal using the reference signal, and recovering the information from the encoded signal.

For the foregoing embodiments, the method may include any one of the following steps, alone or in combination with each other: measuring the encoded signal at a first location and measuring a reference signal synchronously with the encoded signal at a second location spaced apart from the first location; drilling a wellbore and generating information from within the wellbore about downhole equipment within the wellbore; deploying downhole production equipment in a wellbore and generating information from within the wellbore about downhole production equipment; the information includes one or more of measurement-while-drilling data and logging-while drilling data; the first location is spaced approximately 10 km from the second location; the first location is spaced between 5 km and 20 km from the second location; the reference signal is received over a wireless link; the reference signal is received over a cable; the reference signal is synchronized with the encoded signal using global positioning system (GPS) synchronization; the encoded signal is received from a counter electrode; the counter electrode includes a galvanic electrode; the counter electrode includes a capacitive electrode; the encoded signal is encoded using at least one of pulse width modulation, pulse position modulation, on-off keying, amplitude modulation, frequency modulation, single-side-band modulation, frequency shift keying, phase shift keying, discrete multi-tone, and orthogonal frequency division multiplexing; the reference signal is determined based on a strength and direction of a magnetic field induced by a telluric current; the referenced signal is determined based on the strength and direction of the magnetic field in a two-dimensional plane parallel to an earth surface plane; strength and direction of the magnetic field is determined using a crossed pair of magnetic field sensors; the magnetic field sensors; the strength and direction of the magnetic field is determined using one or more inductive coils; the strength and direction of the magnetic field is determined using one or more magnetometers; the reference signal is multiplied by an impedance tensor and scaled by a distance between the first location and a wellhead to determine the telluric voltage signal; and the impedance tensor is estimated prior to receiving the encoded signal; the telluric voltage is subtracted from the received encoded signal.

While the foregoing disclosure is directed to the specific embodiments of the disclosure, various modifications will be apparent to those skilled in the art. It is intended that all variations within the scope and spirit of the appended claims be embraced by the foregoing disclosure.

What is claimed is:

1. An electromagnetic (EM) telemetry system for use with downhole equipment, the system comprising:

a downhole transceiver comprising an encoded signal transmitter;

a downhole sensor disposed to monitor the downhole equipment;

an encoded signal receiver;

a reference receiver spaced apart from the encoded signal receiver and communicatively coupled to the encoded signal receiver, the reference receiver being configured to receive a reference signal comprising sensor information related to a telluric current, wherein the reference signal is determined based on a strength or direction of a magnetic field induced by the telluric current; and a telluric voltage assembly coupled to one of the encoded signal receiver or the reference receiver, wherein the system is operable to:

cancel telluric noise in an encoded signal using the reference signal by multiplying the reference signal by an impedance tensor and scaling the reference signal by a distance between a surface assembly and a wellhead to determine a telluric voltage signal of the telluric voltage assembly; and recovering the sensor information from the encoded signal.

2. The system of claim 1, wherein the downhole sensor is coupled to the transceiver.

3. The system of claim 2, wherein the encoded signal receiver and the reference receiver are disposed adjacent the surface assembly.

4. The system of claim 3, wherein the downhole sensor is selected from the group consisting of temperature sensors, pressure sensors, strain sensors, pH sensors, density sensors, viscosity sensors, chemical composition sensors, radioactive sensors, resistivity sensors, acoustic sensors, potential sensors, mechanical sensors, nuclear magnetic resonance logging sensors, gravity sensor, a pressure sensor, a fixed length line sensor, optical tracking sensor, a fluid metering sensor, an acceleration integration sensor, a velocity timing sensor, an odometer, a magnetic feature tracking sensor, an optical feature tracking sensor, an electrical feature tracking sensor, an acoustic feature tracking sensor, a dead reckoning sensor, a formation sensor, an orientation sensor, an impedance type sensor, and a diameter sensor.

5. The system of claim 4, wherein the reference receiver is communicatively coupled to the encoded signal receiver by a wireless communications transmitter.

6. The system of claim 4, wherein the reference receiver is communicatively coupled to the encoded signal receiver by a cable.

7. The system of claim 5, wherein the reference receiver is spaced approximately 10 km from the encoded signal receiver.

8. The system of claim 7, wherein the encoded signal receiver is coupled to a counter electrode.

9. The system of claim 8, wherein the counter electrode includes a galvanic electrode.

10. The system of claim 8, wherein the counter electrode includes a capacitive electrode.

11. The system of claim 8, wherein the encoded signal comprising the sensor information related to the downhole equipment.

12. The system of claim 11, wherein the encoded signal is encoded using at least one of pulse width modulation, pulse position modulation, on-off keying, amplitude modulation, frequency modulation, single-side-band modulation, frequency shift keying, phase shift keying, discrete multi-tone, and orthogonal frequency division multiplexing.

13. The system of claim 11, wherein the reference signal is determined based on the strength and direction of the magnetic field in a two-dimensional plane parallel to an earth surface plane.

14. The system of claim 11, wherein the reference receiver is coupled to a crossed pair of magnetic field sensors.

15. A method for receiving sensor information from a downhole transceiver, the method comprising:

receiving an encoded signal, the encoded signal being measured at a first location;

receiving a reference signal, the reference signal being measured synchronously with the encoded signal at a second location spaced apart from the first location, the reference signal comprising the sensor information related to a telluric current, wherein the reference signal is determined based on a strength or direction of a magnetic field induced by the telluric current;

canceling telluric noise in the encoded signal using the reference signal by multiplying the reference signal by an impedance tensor and scaling the reference signal by a distance between a surface assembly and a wellhead to determine a telluric voltage signal of a telluric voltage assembly; and recovering the sensor information from the encoded signal.

16. The method of claim 15, further comprising synchronizing the encoded signal with the reference signal using global positioning system (GPS) synchronization.

17. The method of claim 15, further comprising subtracting the telluric voltage signal from the encoded signal to cancel the telluric noise in the encoded signal.

* * * * *